United States Patent [19]

Lobach et al.

[11] 4,234,290

[45] Nov. 18, 1980

[54] TURBINE PUMP

[75] Inventors: James L. Lobach, Broomfield; David A. J. Outteridge, Denver; Gary D. Colwell, Boulder, all of Colo.

[73] Assignee: Binks Manufacturing Company, Franklin Park, Ill.

[21] Appl. No.: 965,173

[22] Filed: Nov. 30, 1978

[51] Int. Cl.[3] ..... F04D 27/00; F04D 29/44

[52] U.S. Cl. ..... 415/145; 415/199.2; 415/207; 415/211

[58] Field of Search ..... 415/207, 211

[56] References Cited

U.S. PATENT DOCUMENTS

| | | | |
|---|---|---|---|
| 2,268,358 | 12/1941 | Turner | 415/211 |
| 2,764,944 | 10/1956 | Lawrence | 415/211 X |
| 3,295,748 | 1/1967 | Leitgeb | 417/440 X |
| 3,876,328 | 4/1975 | Exley | 415/211 |

OTHER PUBLICATIONS

*Principles of Turbomachinery*, Shepherd, MacMillan Co., 1956, p. 156.

*Primary Examiner*—Leonard E. Smith

*Attorney, Agent, or Firm*—Gary, Juettner & Pyle

[57] ABSTRACT

An improved pump for fluid is characterized by one or more turbine pumping stages each having outlet ports configured to provide a constant fluid pressure from the pump for various flow rates of the fluid. The stages are connectable in series so that each increases the pressure of the pumped fluid by a predetermined amount, and each includes a housing having a pumping chamber with an inlet thereto and outlet ports therefrom, and an impeller rotatable in the chamber to move ends of blades thereof past the ports. The ports are uniquely configured to have fluid flow areas which increase with increasing distance from the chamber, whereby the pressure of the pumped fluid remains substantially constant for all flow rates of the fluid up to a design flow rate, and a fluid bypass port of adjustable flow area is provided in at least one of the pumping stages for controlling the pressure of the fluid at an outlet from the pump.

15 Claims, 6 Drawing Figures

30
46
48
50
68
32
66
62
64
56
52
72
54
70
58
76
78
22
42
82
80
74
60
146
130
128
144
134
142
34
96
94
98
108
125
92
106
88
136
102
128
116
100
120
122
36
124
126
28
94
40
114
108
28
118
88
158
128
102
166
162
100
140
138
160
24
170
168
44
26
164

TURBINE PUMP

BACKGROUND OF THE INVENTION

The present invention relates to pumps for fluids, and in particular to an improved turbine pump which develops an essentially constant fluid pressure for various flow rates of the fluid.

Industrial spray coating systems for applying coatings of paint or other material to ware often use a central supply system for providing the material to a plurality of coating stations. A reservoir of the material is maintained in a tank or other relatively large container, and is pumped through supply lines to various stations whereat coating equipment, such as spray guns, is connected with the material in the lines.

Where the material is of a type which settles upon standing, such as paint, the system preferably is of a circulating type which maintains the paint in motion. With such systems paint is pumped from the bottom of the tank through a line extended past all of the spraying stations, and then is returned to the top of the tank. A mixer within the tank agitates the paint therein, and couplings in the line at the stations allow spray paint equipment to be connected therewith.

For improved coating of ware the paint ideally should be provided to the equipment at a predetermined and essentially constant pressure. Accordingly, pumps for such systems advantageously should be capable of developing a preselected and constant fluid outlet pressure. Further, since system load or paint volume requirements normally vary widely from zero in the event that no spray paint equipment is operated to a maximum where all of the equipment simultaneously is operated, the pumps also should be capable of maintaining the predetermined pressure over a wide range of flow rates.

Conventionally, pumps for such systems are of the turbine type and consist of one or more pumping stages. The outlet pressure from such pumps decreases with increasing volumetric output or flow rate therefrom, and if the pump is selected to develop the predetermined pressure under minimum flow rate conditions, then at maximum flow the pressure becomes unsatisfactorily low. In the alternative, if the pump is selected to develop the predetermined pressure at maximum flow, than at minimum flow the pressure becomes prohibitively high which requires some means, such as by-pass valves, for depleting excessive pressure.

Prior attempts to overcome the problems of fluctuating pressures with varying flow rates include selecting pumps which develop the predetermined pressure at average or mid-range flow rates. While such a compromise generally minimizes maximum pressure excursions experienced, under no load conditions the pressure may nevertheless become undesirably high and under maximum load conditions undesirably low.

Another approach to the problem of fluctuating pressures is to pump the paint at the predetermined pressure and at a flow rate which is quite high compared with maximum load requirements. Thus, for minimum or maximum loads the total flow rate from the pump, and therefore the pressure developed thereby, remains generally constant. Unfortunately, this technique has certain disadvantages, one being that a large flow rate at a given pressure requires larger and/or more pumping stages, as well as an increased power input to the pump. Of even greater concern is the frictional heating experienced by the paint when pumped through the system at a high rate of flow. Heating deteriorates the quality of the paint, and may result in color changes thereof.

To avoid undue heating of the paint it has been found that the flow rate should be no more than twice the maximum spray station requirements. That is not a large rate in proportion to maximum requirements, and therefore conventional pumps do not develop an essentially constant pressure in supplying various station requirements.

OBJECTS OF THE INVENTION

An object of the invention is to provide an improved pump for fluids, which has an essentially flat and adjustable pressure response for varying flow rates of the fluid.

Another object of the invention is to provide such a pump of the multiple stage turbine type, which requires minimum numbers of stages to provide a predetermined pressure at various flow rates.

A further object of the present invention is to provide such a pump for use in circulating type paint supply systems.

SUMMARY OF THE INVENTION

In accordance with the present invention, a turbine pump includes a housing having a pumping chamber therein, an impeller in the chamber, a fluid inlet to and fluid outlet passages from the chamber, the outlets being configured to cause fluid to be provided therefrom at a substantially constant pressure for various flow rates of fluid, and adjustable valve means for controlling the pressure of pumped fluid.

In the described embodiment the pump has a plurality of pumping stages driven by a common pump shaft. Each stage increases the pressure of pumped fluid by a predetermined amount and includes an impeller, a diffuser plate and a housing. The diffuser plate has an outer annular ridge defining a circular recess therein, the ridge has a plurality of fluid outlet channels therein of increasing cross-section from an inner to an outer edge of the ridge, and the impeller connects with the shaft and is positioned adjacent the diffuser plate with at least a portion of its blades received in the recess. The housing is positioned on and around the diffuser plate ridge to enclose the impeller in a pumping chamber therein, and has a fluid inlet passage thereto. With the stages interconnected to form the pump the fluid outlet channels from each stage are coupled to the housing inlet to the succeeding stage, if any, and a fluid bypass valve of adjustable flow area is provided in at least one of the stages to channel at least a portion of the fluid therepast, thereby to control the pressure of the pumped fluid.

In consequence of the diffuser plate channels being uniquely configured to increase in cross-sectional area along their length fluid exiting therefrom remains at a substantially constant pressure for various flow rates of fluid, and a minimum number of pumping stages are required to provide a selected flow rate of fluid at a predetermined pressure.

The foregoing and other objects, advantages and features of the invention will become apparent from the following detailed description, when taken in conjunction with the accompanying drawings.

DETAILED DESCRIPTION

Figure 1:
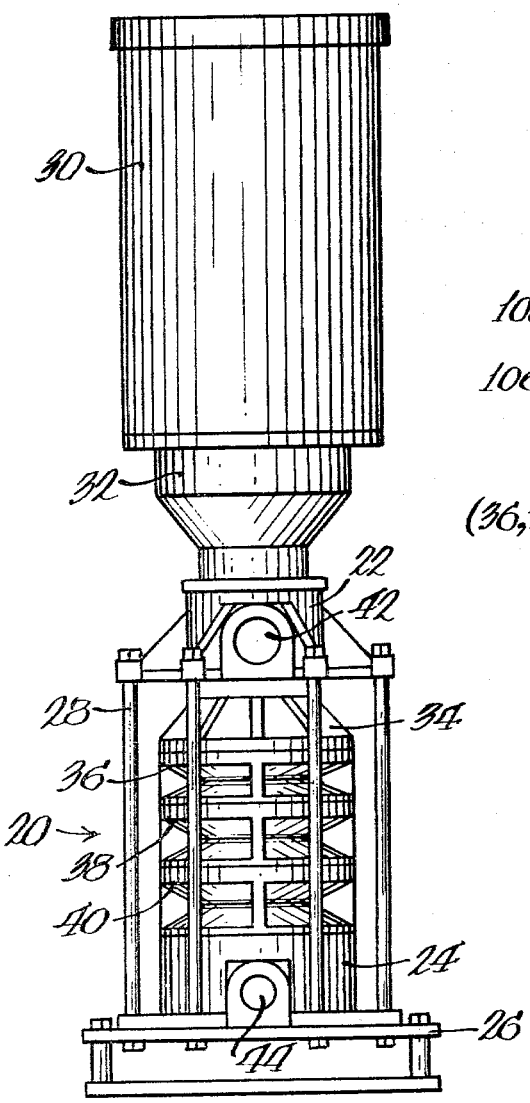
FIG. 1 is a side elevation view of an assembled four-stage turbine pump embodying the teachings of the present invention.

Referring to FIG. 1, the turbine pump of the invention, indicated generally at 20, pumps fluid at substantially a constant pressure for all flow rates of the fluid up to a design flow rate, and includes a plurality of pumping stages connected in a stacked, series relationship between an inlet housing 22 and an outlet housing 24. The housings and stages are fastened together and to a base 26 by a plurality of tie rods 28, and an electric motor 30 supported by a motor mount 32 above the inlet housing provides operating power to the stages through a common pump shaft. The pumping stages as shown include first, second, third and fourth stage housings 34, 36, 38 and 40, each of which has a fluid flow path therethrough between an inlet thereto and an outlet therefrom. As interconnected, the flow paths are in series between a fluid inlet opening 42 to the housing 22 and a fluid outlet opening 44 from the housing 24, and the pump shaft extends through and connects with each of the stages. Each stage sequentially increases the pressure of a fluid pumped therethrough by a predetermined amount, whereby the overall fluid pressure from the pump is equal to the sum of the pressure increases provided by the individual stages.

Figure 2:
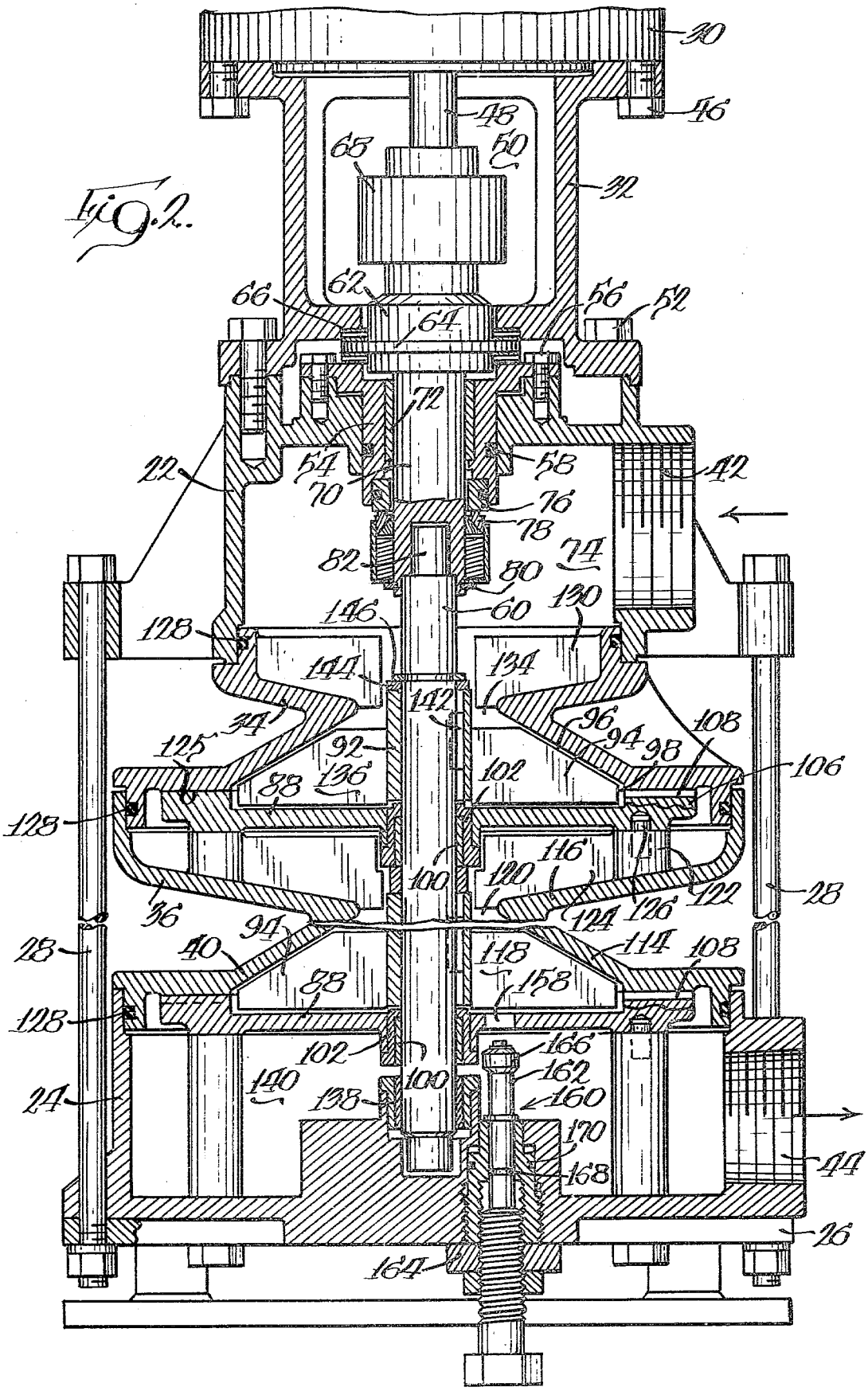
FIG. 2 is a partial, fragmentary, cross-sectional elevation view of the pump, illustrating the structure of the various stages thereof and their connection with a motor driven pump shaft.

Referring also to FIG. 2, the motor 30 is fastened to the motor mount 32 by a plurality of bolts 46, with a motor shaft 48 extended into a chamber 50 in the mount. The mount is in turn fastened to the inlet housing 22 by a plurality of bolts 52, and an inlet housing guide 54 within a passage through the upper end of the housing is secured therein by bolts 56 with an O-ring 58 forming a seal between the guide and the housing. Means for connecting the motor shaft with a pump shaft 60 for operating the pumping stages includes a coupling adapter 62 having an annular shoulder 64 rotatably supported within an annular recess formed between the mount 32 and the guide 54 by sets of bearings and races 66 on opposite sides of the shoulder. The upper end of the adapter extends into the chamber 50 and is connected with the motor shaft 48 through a couple 68 which may comprise, by way of example, a chain extended around and between a gear on the lower end of the motor shaft and a gear on the upper end of the adapter. The lower end of the coupling adapter is keyed with the upper end of a pump shaft adapter 70 rotatably positioned within a sleeve bearing 72 in a passage through the inlet housing guide 54, and the lower end of the pump shaft adapter extends into a fluid receiving chamber 74 in the inlet housing. A stationary face seal 76 between the pump shaft adapter and the inlet housing guide, and a rotaty face seal 78 between the stationary face seal and a lower annular portion 80 of the pump shaft adapter, prevent passage of fluid from the chamber 74 through the inlet housing guide. The pump shaft 60 is conveniently and detachably connected with the lower end of the pump shaft adapter 70 by a square shaped upper end 82 of the shaft which slidably is received within a complementary recess in the adapter, whereby operation of the motor rotates the pump shaft through the couple 68, the coupling adapter 62, and the pump shaft adapter 70.

Figure 3:
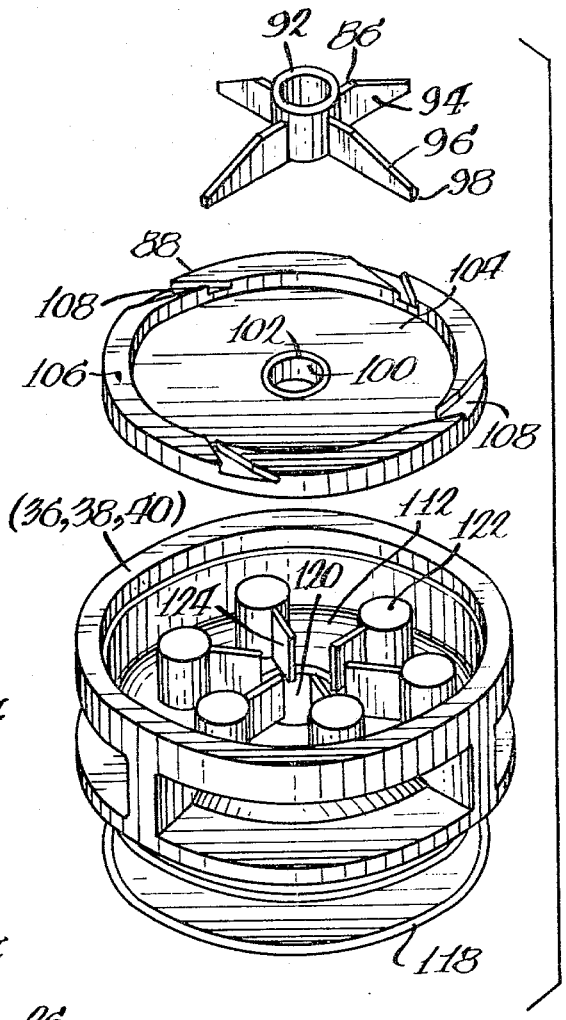
FIG. 3 is a partial perspective assembly view of a pumping stage, showing the channeled diffuser plate which provides a constant fluid pressure from the pump for various fluid flow rates.

Referring additionally to FIG. 3, each pumping stage includes an impeller 86, a diffuser plate 88, and a housing, the particular housing shown being any one of the housings 36, 38 or 40 intermediate the first stage housing 34 and the outlet housing 24. The impeller has a cylindrical or tubular center body portion 92 extendable around the pump shaft 60, and a plurality of blades 94 (four in the embodiment shown) extending radially outward therefrom at equally spaced intervals therearound. Each blade is tapered as at 96 toward an upstanding outer edge or end 98. The diffuser plate has a center passage within which is a sleeve bearing 100 in a holder 102, and an annular ridge 106 around the circumference thereof defining therein a circular recess 104 for receiving the lower portions of the impeller blades 94. The ridge has a flat upper surface with a plurality of uniquely configured and equally spaced channels or ports 108 formed therein from an inner to an outer edge thereof. Preferably, the ports are equal in number to the impeller blades, whereby in the operation of the pump the ends of the blades pass the inner ends of the ports simultaneously to eliminate small, high frequency pressure pulsations in the pumped fluid, as will be described. The housings 36, 38 and 40 each comprise a generally cylindrical body portion which extends inwardly along upper 112 and lower 114 wall sections to define both upper 116 and lower 118 chambers in the housing and a passage 120 between the chambers and through the housing. A plurality of posts 122 are in a circular array on the surface of the wall section 112, and each has formed therewith a vane 124 extending radially inward along the surface and partially beyond the edge of the passage 120.

Referring particularly to FIG. 2, in assembling the pumping stages a diffuser plate is positioned within the upper chamber 116 of a housing to rest its lower surface on the posts 122 therein, and is rotationally oriented by a guide pin 126. An impeller is positioned with the lower edges of its blades nestled within the recess 104 in the diffuser plate for rotation of the outer ends of the blades past the ports 108. To this end, the diameter of the impeller is very slightly smaller than the diameter of the diffuser plate recess, whereby with rotation of the impeller the ends of the blades closely pass by the inner ends of the ports. The housings 22, 34, 36, 38, 40 and 24 (the housing 38 not being shown in the fragmented view) are joined in a stacked relationship and are mounted with a lower flat surface 125 of each housing of a pumping stage supported on the upper flat surface of the ridge 106 of the diffuser plate of that stage, and with the impeller enclosed within the lower pumping chamber 118 of the housing. The housing surface 125 thus provides an upper closure wall for the channels through the diffuser plate, whereby the channels define fluid outlet passages from the pumping chambers, and O-rings 128 form fluid tight seals between the housings. The first stage housing 34 is similar to the housings 36, 38 and 40, except that since no diffuser plate is positioned in an upper chamber portion 130 thereof, there are no upstanding posts 122 therein. Rather, only a plurality of vanes 132 extend radially within the chamber and partially across a passage 132 joining the upper chamber with a lower pumping chamber 136, which chamber 136 is like the lower chambers 118 of the housings 36, 38 and 40.

The pump shaft 60 extends through the center passages 120 in the housings, is rotatably supported within the sleeve bearings 100 of the diffuser plates, and terminates at its lower end within a sleeve bearing 138 in a chamber 140 of the outlet housing 24. The shaft also extends through the center portions 92 of the impellers, and keys 142 both fasten the impellers to the shaft for rotation therewith and orient the impellers with respect thereto, so that the ends 98 of all of the blades move simultaneously past the ports of the diffuser plates. To maintain the impellers properly vertically positioned on the shaft, a spacer 144 and a retaining ring 146 are provided on the shaft immediately above each impeller to limit upward movement thereof, and the upper ends of the sleeve bearing mounts 102 limit downward movement thereof. This accurately positions each impeller so that the tapered edges 96 of its blades are parallel to and closely spaced from the wall section 114 of its associated housing, the lower edges of the blades are parallel to and closely spaced from the surface of its associated diffuser plate, and outer ends 98 of the blades are parallel to and closely spaced from the inner edge of the ridge 106, whereby a compact and efficient pumping chamber is provided.

In the operation of the pump, fluid from a supply thereof (not shown) connected with the inlet 42 to the housing 22 enters the chamber 74 therein and the upper chamber 130 in the first stage housing 34. With the motor 30 rotating the impellers, the fluid is guided by the vanes 132 through the passage 134 and into the lower pumping chamber 136 of the housing, whereat the rotating impeller blades move the fluid by centrifugal force to the ends of the blades and force the fluid through the ports 108 in the diffuser plate. The fluid exits the ports into the upper chamber 116 of the succeeding second stage housing 36 at a predetermined elevated pressure, wherein it is guided by the vanes 124 through the passage 120 and into the lower pumping chamber 118 thereof. The second pumping stage, and thereafter the third and fourth stages, each sequentially elevates the pressure of the fluid in a similar manner, so that the fluid pumped from the fourth stage into the chamber 140 and through the outlet 44 is increased in pressure, as compared with the pressure of the fluid entering the inlet 42, by an amount equal to the sum of the individual pressure increases provided by each of the stages.

Figure 4:
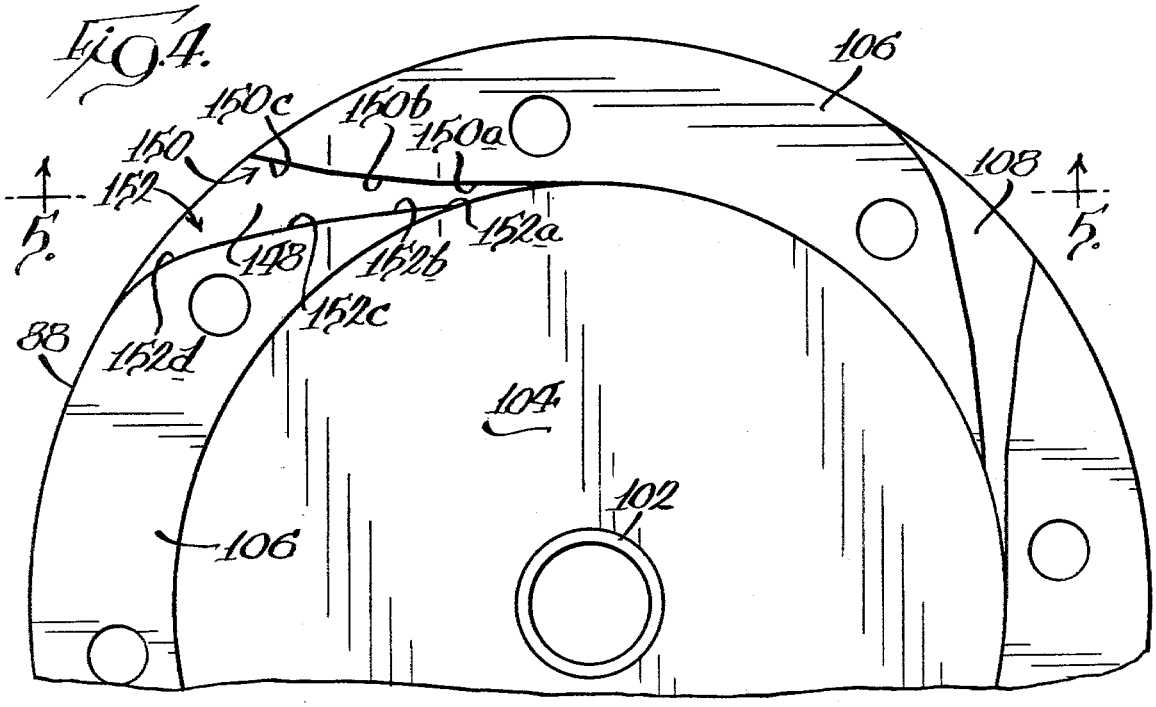
FIG. 4 is a partial top plan view of the diffuser plate, particularly illustrating the configuration of the channels therein.
Figure 5:
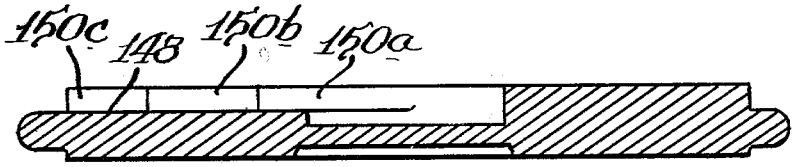
FIG. 5 is taken substantially along the lines 5—5 of FIG. 4 and shows the cross-sectional configuration of a diffuser plate channel.

It has been found that when the outlet passages or ports 108 in the diffuser plates 88 are uniquely configured in accordance with the invention, the pump exhibits substantially a flat pressure response for all flow rates of the fluid up to a design flow rate. Referring to FIGS. 4 and 5, each port 108 is comprised of a channel or slot formed in the upper surface of the ridge 106, and has a base wall 148 and opposite side walls, indicated generally at 150 and 152, extending perpendicularly therefrom. The ports increase in width from the inner to the outer edges of the ridge, and particular advantages are obtained when the wall 150 is comprised of three straight wall segments **150*a*, 150*b* and 150*c* joined at successive angles of 6°, and when the wall area 152 also is comprised of three straight wall segments 152*a*, 152*b* and 152*c*, joined at successive angles of 6°, and a fourth curved wall segment 152*d* continuous with and tangential to the segment 152*c*. The segment 150*a* is tangent to the inner edge or circumference of the ridge 106, and is parallel to the segment 152*a*. Then, at a point in the channel along a perpendicular between the segments 150*a* and 152*a*, the wall areas diverge outwardly at an angle of 12° to form the segments 150*b* and 152*b*. The segments 150*b* and 152*b* are of equal length, and at their ends at a second point along the channel the walls 150 and 152 diverge outwardly at an angle of 24° to form the segments 150*c* and 152*c*. The segment 150*c* extends to the outer circumference or edge of the ridge 106, and the segment 152*c* extends to a third point along the channel whereat it is tangent to and joins with the curved segment 152*d*,** with in turn extends to and is tangent to the outer edge of the ridge. Because the fluid flow area of the ports increases from the inlet to the outlet thereof, fluid passing therethrough increases in pressure from the inlet to the outlet, and the particular design of the port provides a recovery for the fluid that allows the pressure thereof to remain constant for various flow rates of the fluid.

Figure 6:
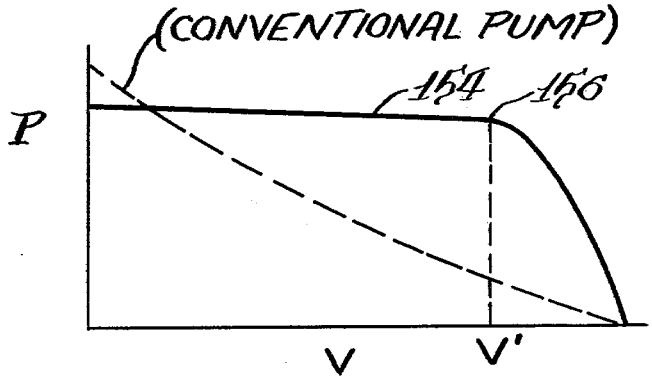
FIG. 6 is a graph of the pressure-volume characteristics of the pump of the invention and of a conventional prior art pump.

FIG. 6 illustrates pressure-volume curves of both a conventional prior art turbine pump and the pump of the invention, and clearly demonstrates the significantly improved pressure response for various flow rates obtained with the pump of the invention. With the conventional pump, the developed pressure is maximum under static conditions when no fluid flows from the pump, and decreases in value relatively rapidly with increasing volumes of fluid flow. With the pump of the invention, however, the developed pressure remains substantially constant, as shown by a portion 154 of the curve, for all volume flow rates of fluid ranging from zero to a design flow rate at a volume V′ whereat a knee 156 occurs. Thereafter, the pressure decreases with increasing flow rates of fluid.

The substantially constant pressure developed by the pump and the volume flow V′ at which the knee 156 occurs are independently determined by the design of the pump. The pressure conveniently and economically is determined by the diameter of the impellers and their speed of rotation, and by the number of pumping stages, with larger diameter impellers and/or an increase in their speed of rotation and/or a greater number of stages increasing the pressure developed by the pump, and vice versa. The design flow rate is readily determined by the flow areas of the diffuser plate ports, which conveniently may be varied by the simple and inexpensive expedient of making the ports shallower or deeper without changing the shape of or spacing between the wall areas thereof. Deeper ports increase the volume flow at which the knee in the curve occurs, and shallower ports decrease the volume flow at which the knee is reached. It is to be appreciated that the pressure and design flow rate are independent of each other, with a design change in the pressure having no effect whatsoever on the design flow rate, and vice versa.

Having selected a nominal output pressure of the pump based upon the diameter of the impellers, their speed of rotation and the number of pumping stages, means advantageously are provided for adjusting or controlling the output pressure within a limit range without affecting the pressure stability of the pump for changing fluid flow rates.

Referring to FIG. 2, the pressure adjusting means may comprise a fluid bypass port 158 formed through the diffuser plate 88 of the last pumping stage, and a valve means, indicated generally at 160, in the outlet housing 24 for controlling the fluid flow area through the bypass port. The valve means includes a valve stem 162 threadably received within a screw 164 in a lower end of the inlet housing, and adjustable therein to move a headed valve end 166 thereof between positions closing and opening the bypass port. An O-ring 168 forms a sliding seal between the valve stem and the screw 164, and an O-ring 170 seals the screw with the outlet housing.

With the valve head 166 seated against and closing the bypass port 158, the pump develops a maximum pressure at the outlet 44 as determined by the diameter and speed of rotation of the impellers, and the number of pumping stages. To selectively control or decrease the pressure within a limited range, the valve means is adjustable to open the bypass port and to establish a selected flow area therethrough, whereby a portion of the fluid in the last pumping stage is admitted directly into the outlet housing chamber 140 without being increased in pressure by the stage.

With each stage increasing the fluid pressure by, for example, 50 p.s.i., it has been found that with a bypass port of approximately ¾ inch diameter an output pressure adjustment of approximately 30 p.s.i. may be obtained with a low viscosity fluid, and of approximately 20 p.s.i. with a heavy viscosity fluid. The valve means therefore provides a convenient means for fine adjustment of the pressure of the fluid at the outlet from the pump, without affecting the pressure stability of the pump for various and changing flow rates of the fluid.

The invention thus provides an improved turbine pump of compact, efficient and economical design. As a consequence of the uniquely configured diffuser plate ports the pump exhibits an essentially flat or constant pressure response for all flow rates of fluid up to a design flow rate. The design flow rate may readily be determined by the depth of the ports in the diffuser plates, and the pressure by the diameter and speed of rotation of the impeller, and/or by the number of individual pumping stages, with the total pressure developed by the pump then being the sum of the pressures developed by the individual stages. The pressure may then be finely tuned or adjusted to a predetermined value by the valve means while the pump is operating, which enables a very precise control over the pressure output of the pump. For greatest economy and convenience, the pumping stages may each be manufactured to a standard specification to develop a predetermined pressure at a predetermined impeller speed of rotation, and the total maximum pressure developed by the pump may then readily be determined by the number of interconnected stages, which may of course range from a single stage to as many as is both practical and required.

The constant pressure pump of the invention advantageously may be used in applications wherein a constant pressure, variable flow rate of fluid is required. One such application is in spray paint systems where paint from a supply thereof is provided through a supply line to spray paint equipment at a plurality of stations. With such systems, the flow rate of paint through the supply line varies in accordance with the number of stations operating, yet the pressure of the paint in the line desirably should be maintained constant to ensure consistently uniform operation of the equipment. In this application the pump is connected at its inlet 42 with the supply of paint, and at its outlet 44 with the supply line, and provides paint at a constant pressure to the spray paint equipment for varying flow rates thereof. As each pumping stage typically developes about 50 psi, and as spray paint equipment ordinarily requires paint at about 175–200 psi, the pump in this case would be comprised of four pumping stages.

Another such application is in a circulating type system. In this case, the supply line returns to the paint supply, and the pump constantly circulates the paint through the line to prevent the paint from settling.

While one particular embodiment of the invention has been described in detail, it is understood that various modifications and other embodiments thereof may be devised by one skilled in the art without departing from the spirit and scope of the invention, as defined by the appended claims.

What is claimed is:

1. A turbine pump for delivering fluidic coating material under pressure to coating equipment at one or more coating stations, comprising a plate having an annular ridge on a surface thereof forming a circular recess therein, said ridge having channels formed therein from an inner edge adjacent said recess to an outer edge thereof, said channels having a cross-sectional area which increases along their length from inner ends thereof at said inner edge to outer ends thereof at said outer edge; an impeller having outwardly extending blades positioned with at least a portion of said blades in said recess, said impeller being rotatable to move edges of said blades closely past said inner ends of said channels; a housing having walls forming a chamber therein and an opening thereto, positioned with portions of said walls around said opening on and around said ridge to enclose said impeller within said chamber, said housing having an inlet to said chamber for connection with a supply of coating material and said channels providing fluid outlets from said chamber for connection with the coating equipment; means for rotating said impeller within said housing, whereby with a constant speed of rotation of said impeller coating material supplied through said inlet is pumped from said outlets at an increased and substantially constant pressure despite variations in the flow rate of the material; and valve means for shunting a selected portion of the coating material around said outlets to control the pressure of the coating material delivered to the coating equipment, each said outlet having a base wall and side walls formed by said plate and a top wall provided by said wall margins of said housing, said base and top walls being substantially parallel, said side walls being substantially straight and parallel from said inner edge of said ridge to a first point along said channel, said side walls being substantially straight and diverging at a first angle from said first point to a second point along said channel, said side walls being substantially straight and diverging at a second and greater angle from said second point, one of said side walls being substantially straight from said second point to said outer edge of said ridge, the other of said side walls being substantially straight from said second point to a third point along said channel and being smoothly curved away from said one side wall from said third point to said outer edge of said ridge, said one side wall being tangent to said inner edge, said first angle being substantially 12°, said second angle being substantially 24°, and said other wall between said third point and said outer edge of said ridge being tangent both to said outer edge and to the portion thereof between said second and third points, said channels extending from said inner to outer ends thereof in directions generally along the direction of motion of said blade edges moving therepast, said one wall between said first and said second points extending 6° out of the plane of said portion thereof between said inner edge and said first point in a direction away from said other wall, and said one wall between said second point and said outer edge extending 12° out of the plane of said portion thereof between said inner edge and said first point in a direction away from said other wall, said impeller having a tubular center body portion about said axis and said blades extending outwardly therefrom, said means for rotating said impeller including a rotatable shaft extended into said housing and secured with said center body portion, said inlet to said housing being formed about said shaft and said shaft extending therethrough, said pump providing coating material from said outlets at a pressure determined by the speed of rotation of said impeller and the diameter thereof such that increasing speeds of rotation and increasing impeller diameters increase said pressure, said pressure being substantially constant for all coating material flow rates up to a design flow rate, said design flow rate being determined by the overall cross-sectional areas of said channels such that increasing said cross-sectional areas increases said design flow rate, and including a plurality of said pumps connected in series and having said impellers thereof rotated by said shaft, said housing of each said pump being connected with said outlets therefrom communicationg with said inlet to a succeeding housing, if any, said pumps forming a path therethrough for coating material from said inlet to the first pump housing to said outlets from the last pump housing, said plates having passages therethrough coaxial with said tubular center body portions of said impellers, said shaft extending through said plate passages and said tubular portions of said impellers and secured to each of said impellers for rotation thereof, each of said pumps increasing the pressure of coating material pumped therethrough by a predetermined amount, whereby coating material entering said inlet of said first pump housing exists said outlets from said last pump housing at an increased pressure which is the sum of said predetermined amounts.

2. A pump for delivering coating material under pressure to coating equipment at one or more coating stations, comprising a housing having a chamber therein, an inlet to said chamber for connection with a supply of coating material, and outlets from said chamber for connection with the coating equipment; an impeller within said chamber, said impeller having a plurality of blades and being rotatable to move edges of said blades past said outlets to pump coating material from said inlet through said outlets, said outlets having fluid flow areas which increase with increasing distance from said chamber, whereby with a constant speed of rotation of said impeller coating material is pumped from said outlets to the coating equipment at substantially a constant pressure despite variations in the flow rates thereof; and bypass valve means for bypassing a selected portion of the coating material away from the edges of said impeller blades and around said outlets to control the pressure of the coating material delivered to the coating equipment, each said outlet having a top wall, a bottom wall and a pair of side walls, said top and bottom walls being generally parallel and said side walls being generally straight and parallel from said chamber to a first point along said passage, said side walls being generally straight and diverging at a first angle from said first point to a second point along said passage, said side walls being generally straight and diverging at a second and greater angle from said second point, one of said side walls being generally straight from said second point to an end of said passage from said chamber, the other of said side walls being generally straight from said second point to a third point along said passage and being curved away from said one side wall from said third point to said end of said passage, wherein neither of said side walls is planar between said chamber and said end of said passage away from said passage.

3. A pump for coating material as in claim 2, said side walls diverging from said first point at an angle of about 12° and from said second point at an angle of about 24°.

4. A turbine pump for delivering fluidic coating material under pressure to coating equipment at one or more coating stations, comprising a plate having an annular ridge on a surface thereof forming a circular recess therein, said ridge having channels formed therein from an inner edge adjacent said recess to an outer edge thereof, said channels having a cross-sectional area which increases along their length from inner ends thereof at said inner edge to outer ends thereof at said outer edge; an impeller having outwardly extending blades positioned with at least a portion of said blades in said recess, said impeller being rotatable to move edges of said blades closely past said inner ends of said channels; a housing having walls forming a chamber therein and an opening thereto, positioned with portions of said walls around said opening on and around said ridge to enclose said impeller within said chamber, said housing having an inlet to said chamber for connection with a supply of coating material and said channels providing fluid outlets from said chamber for connection with the coating equipment; means for rotating said impeller within said housing, whereby with a constant speed of rotation of said impeller coating material supplied through said inlet is pumped from said outlets at an increased and substantially constant pressure despite variations in the flow rate of the material; and valve means for shunting a selected portion of the coating material away from the edges of said impeller blades and around said outlets to control the pressure of the coating material delivered to the coating equipment, each said outlet having a base wall and side walls formed by said plate and a top wall provided by said wall margins of said housing, said base and top walls being substantially parallel, said side walls being substantially straight and parallel from said inner edge of said ridge to a first point along said channel, said side walls being substantially straight and diverging at a first angle from said first point to a second point along said channel, said side walls being substantially straight and diverging at a second and greater angle from said second point, one of said side walls being substantially straight from said second point to said outer edge of said ridge, the other of said side walls being substantially straight from said second point to a third point along said channel and being smoothly curved away from said one side wall from said third point to said outer edge of said ridge, wherein neither of said side walls is planar between said inner and outer edges of said ridge.

5. A turbine pump for coating material as in claim 4, said impeller blades being at equally spaced angles about an axis of said impeller, said inner ends of said channels being equally spaced around said inner edge of said ridge and said channels being of like number with said blades, whereby said edges of said blades move simultaneously past said inner ends of all of said channels.

6. A turbine pump for coating material as in claim 4, said one side wall being tangent to said inner edge, said first angle being substantially 12°, said second angle being substantially 24°, and said other wall between said third point and said outer edge of said ridge being tangent both to said outer edge and to the portion thereof between said second and third points.

7. A turbine pump for coating material as in claim 6, said channels extending from said inner to outer ends thereof in directions generally along the direction of motion of said blade edges moving therepast, said one wall between said first and said second points extending 6° out of the plane of said portion thereof between said inner edge and said first point in a direction away from said other wall, and said one wall between said second point and said outer edge extending 12° out of the plane of said portion thereof between said inner edge and said first point in a direction away from said other wall.

8. A turbine pump for coating material as in claim 7, said impeller having a tubular center body portion about said axis and said blades extending outwardly therefrom, said means for rotating said impeller including a rotatable shaft extended into said housing and secured with said center body portion, said inlet to said housing being formed about said shaft and said shaft extending therethrough, said pump providing coating material from said outlets at a pressure determined by the speed of rotation of said impeller and the diameter thereof such that increasing speeds of rotation and increasing impeller diameters increase said pressure, said pressure being substantially constant for all coating material flow rates up to a design flow rate, said design flow rate being determined by the overall cross-sectional areas of said channels such that increasing said cross-sectional areas increases said design flow rate.

9. A turbine pump for coating material as in claim 8, including a plurality of said pumps connected in series and having said impellers thereof rotated by said shaft, said housing of each said pump being connected with said outlets therefrom communicating with said inlet to a succeeding housing, if any, said pumps forming a path therethrough for coating material from said inlet to the first pump housing to said outlets from the last pump housing, said plates having passages therethrough coaxial with said tubular center body portions of said impellers, said shaft extending through said plate passages and said tubular portions of said impellers and secured to each of said impellers for rotation thereof, each of said pumps increasing the pressure of coating material pumped therethrough by a predetermined amount, whereby coating material entering said inlet of said first pump housing exits said outlets from said last pump housing at an increased pressure which is the sum of said predetermined amounts.

10. A turbine pump for coating material as in claim 9, all of said impellers being oriented on said shaft such that said edges of all of said blades move simultaneously past said inner ends of all of said channels.

11. A turbine pump for coating material as in claim 9, an inlet housing having a chamber therein and an inlet to said chamber for connection with the supply of coating material, connected with said first pump housing with said inlet housing chamber in communication with said first pump housing inlet, and an outlet housing having a chamber therein and an outlet from said chamber for connection with said coating equipment, connected with said last pump housing with said outlet housing chamber communicating with said last pump housing outlets.

12. A turbine pump for coating material as in claim 11, said valve means including bypass valve means in said plate of said last pump and adjustable to connect a selected portion of the coating material in said last pump housing chamber directly with said outlet housing chamber without the coating material passing through said last pump housing outlets, thereby to control the pressure of the coating material at said outlet from said outlet housing and delivered to the coating equipment.

13. A turbine pump for coating material as in claim 11, said inlet housing having an opening about said shaft and said shaft extending therethrough, and including an electric motor mounted on said inlet housing and having a motor shaft; means for coupling said motor shaft with said other shaft, whereby operation of said motor rotates said other shaft; and seal means in said inlet housing opening sealing said opening.

14. A turbine pump for coating material as in claim 11 for providing coating material under pressure to coating equipment at a plurality of coating stations, including means for connecting said inlet housing inlet with a supply of the coating material, and means for connecting said outlet housing outlet with the coating equipment at the stations, said pump providing coating material to the equipment from the supply thereof at substantially a constant pressure irrespective of variations in the flow rate of the material.

15. A turbine pump for coating material as in claim 11 for providing coating material under pressure to coating equipment at a plurality of coating stations, including means for connecting said inlet housing inlet with a supply of the coating material, and means for connecting said outlet housing outlet with the coating equipment at the stations and thereafter with the supply of the material, said pump providing a continuous flow of coating material to the equipment from the supply thereof at substantially a constant pressure irrespective of variations in the flow rate of the material, the coating material not used at the stations returning to the supply thereof.

* * * * *